United States Patent [19]

Shim

[11] 4,260,501

[45] Apr. 7, 1981

[54] LUBRICANT COMPOSITIONS CONTAINING ANTIOXIDANT MIXTURES COMPRISING SUBSTITUTED THIAZOLES AND SUBSTITUTED THIADIAZOLE COMPOUNDS

[75] Inventor: Joosup Shim, Wenonah, N.J.

[73] Assignee: Mobil Oil Corporation, New York, N.Y.

[21] Appl. No.: 37,966

[22] Filed: May 11, 1979

[51] Int. Cl.[3] ..... C10M 1/38

[52] U.S. Cl. ..... 252/47.5; 252/402; 252/403

[58] Field of Search ..... 252/47.5, 402, 403

[56] References Cited

U.S. PATENT DOCUMENTS

| | | | |
|---|---|---|---|
| 2,719,125 | 9/1955 | Roberts | 252/47 X |
| 4,048,082 | 9/1977 | Nnadi et al. | 252/51.5 A |
| 4,153,565 | 5/1979 | Braid et al. | 252/51.5 A |

*Primary Examiner*—Andrew Metz

*Attorney, Agent, or Firm*—Charles A. Huggett; Michael G. Gilman; James D. Tierney

[57] ABSTRACT

Lubricant compositions containing oleaginous materials and, in an amount sufficient to impart oxidation stability and corrosion resistance thereto, an adduct of a benzotriazole compound and an alkyl vinyl ether or a vinyl ester of a carboxylic acid in combination with an alkyl dimercapto thiadiazole.

2 Claims, No Drawings

LUBRICANT COMPOSITIONS CONTAINING ANTIOXIDANT MIXTURES COMPRISING SUBSTITUTED THIAZOLES AND SUBSTITUTED THIADIAZOLE COMPOUNDS

BACKGROUND OF THE INVENTION

1. Field of the Invention

The invention relates to oleaginous compositions normally susceptible to oxidative deterioration. In particular, the invention relates to compositions such as mineral and synthetic lubricating oils, gear oils, transmission fluids, turbine oils, greases and other oleaginous compositions normally requiring additives.

2. Description of the Prior Art

Prior to the present invention, triazoles have been employed in lubricant compositions as metal deactivators. For example, U.S. Pat. No. 3,597,353 of Randell et al. discloses the use of 4, 5, 6, 7 tetrahydrobenzotriazole as a metal deactivating additive for natural and synthetic lubricants. Similarly, U.S. Pat. No. 3,413,227 of Howard et al. teaches that an alkyl-substituted benzotriazole where the alkyl group contains from 2 to 20 carbon atoms can be used as a corrosion or tarnish inhibitor.

Bridger et al., in U.S. Pat. No. 4,060,491, disclose utilizing 5-alkyl benzotriazoles, in which the alkyl group contains from 4 to 16 carbon atoms, in a method for reducing wear between moving steel-on-steel surfaces.

In U.S. Pat. No. 3,788,993 of Andress, it is taught that benzotriazoles react with alkyl of alkenylsuccinic anhydrides to form reaction products which impart corrosion inhibiting properties to lubricating oils.

Nnadi et al., in U.S. Pat. No. 4,048,082, teach that esters of adducts of benzotriazole and unsaturated dicarboxylic acids or anhydrides impart antirust properties to organic compositions.

U.S. application Ser. No. 915,856, filed June 15, 1978 now U.S. Pat. No. 4,153,565 teaches lubricant compositions containing the same benzotriazole reaction product as used in the present invention.

None of these patents disclose the combined additive of this invention.

SUMMARY OF THE INVENTION

In accordance with the invention, there is provided a lubricating composition containing a major amount of an oleaginous material and an antioxidant amount of a mixture of (1) an adduct of a benzotriazole compound and a vinyl ether or a vinyl ester of a carboxylic acid and (2) an alkyl dimercapto thiadiazole.

DESCRIPTION OF SPECIFIC EMBODIMENTS

In general, the benzotriazole adducts used in the mixture of the present invention are formed by reacting a benzotriazole compound with a vinyl ether or a vinyl ester of a carboxylic acid.

The benzotriazole compounds which may be used to form the adducts of the present invention have the formula:

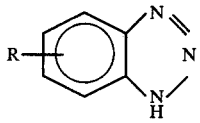

where R is hydrogen or hydrocarbyl containing from 1 to 12 carbon atoms, and preferably is hydrogen or an alkyl group containing from 1 to about 8 carbon atoms. Particularly preferred are benzotriazole and toluotriazole.

The vinyl ethers and vinyl esters which may be utilized in forming the adducts of the present invention have the formulae:

$$R'CH{=}CHOR'' \quad \text{and} \quad R'CH{=}CHO\overset{\overset{\displaystyle O}{\|}}{C}{-}R'''$$

respectively, where R′ is hydrogen or an alkyl group containing from 1 to 8 carbon atoms in any isomeric arrangement, R″ is an alkyl group containing from 1 to 18 carbon atoms in any isomeric arrangement, and R‴ may be the same as R″ or may be an aryl group, an alkaryl group or an aralkyl group containing from 1 to 18 carbon atoms.

Preferred are those vinyl ethers and vinyl esters wherein R′ is hydrogen or an alkyl group containing from 1 to 11 carbon atoms, R″ is an alkyl group containing from 1 to 8 carbon atoms, and R‴ is an alkyl, aralkyl or alkaryl group containing from about 1 to 14 carbon atoms. All stated carbon atom ranges are inclusive.

Particularly preferred are those vinyl ethers and vinyl esters wherein R′ is hydrogen or alkyl of 1 to 2 carbon atoms, R″ is an alkyl group containing from 1 to 4 carbon atoms, and R‴ is an alkyl or aryl group containing from 1 to 6 carbon atoms.

The benzotriazole compounds of the present invention are formed by reacting the benzotriazole compound with the vinyl ether or vinyl ester of a carboxylic acid in proportions, expressed as molar ratios of benzotriazole compound to vinyl ether or vinyl carboxylate, of from 1:1 to about 1:10, with from about 1:1 to about 1:1.5 being preferred.

Temperatures from about 25° C. to about 150° C., with from about 80° C. to about 120° C. being preferred, are utilized. In general, the reactants are contacted for about 1 to about 8 hours, with from about 2 to about 4 hours being preferred. As those of skill in the art are aware, the particular reaction times utilized depend on the temperature and the reactants employed. Thus, at high temperatures, the reaction time may be shorter than the time at lower temperatures, for a given pair of reactants.

The reaction often proceeds without the presence of any catalyst. However, catalysts of an acidic nature, such as acetic acid, propionic acid, toluenesulfonic acid, phosphonic or polyphosphonic and methanesulfonic acids may be employed. Basic catalysts can also be used. Typical examples include sodium or potassium alkoxides, sodium or potassium metal and their hydroxides, etc.

The benzotriazole products of the present invention may comprise several isomers, i.e., the vinyl ethers and vinyl esters may connect to the benzotriazole in either the 1-H or 2-H position. Also, both Markownikow and anti-Markownikow additions may occur. It has been found that each isomer is individually effective in imparting the improved antioxidant and anti-corrosion properties to the lubricant compositions. Accordingly, as used herein the term "adducts" or "benzotriazole products(s)" may refer to any of the isomers produced, or the mixture of isomers.

The thiadiazoles useful in the practice of this invention are more particularly called 2,5-dimercapto-1,3,4-thiadiazole, and they have the formula

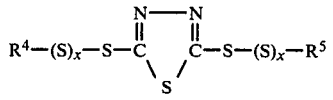

wherein $R^4$ and $R^5$ are hydrocarbyl groups, either the same or different, containing from 1 to 30 carbon atoms and x is 0 to 8. $R^4$ and $R^5$ can be alkyl, aryl, alkaryl or aralkyl, preferably alkyl, and specifically include methyl, butyl, octyl, decyl, dodecyl, octadecyl, phenyl, tolyl, benzyl, and the like. They can be made in accordance with the method described in U.S. Pat. No. 2,719,125, incorporated herein by reference.

The thiadiazole may be purchased from commercial sources. The one illustrated herein is the alkyl derivative of 2,5-dimercapto-1,3,4-thiadiazole, wherein the alkyl is tertiary octyl, was purchased as Amoco 150.

The present invention provides improved resistance to oxidation of oleaginous materials such as lubricating media which may comprise liquid oils, including those of lubricating viscosity, in the form of either a mineral oil or a synthetic oil, or in the form of a grease therefrom. In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F., and preferably, from about 50 to about 250 SSU at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in grease-forming quantities in such degree as to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects any material which is normally employed for thickening or gelling hydrocarbon fluids for forming grease can be used in preparing the aforementioned improved grease in accordance with the present invention.

In instances where synthetic oils, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated mineral oils, chain-type polyphenyls, siloxanes and silicones (polysiloxanes), alkyl-substituted diphenyl ethers typifiled by a butyl-substituted bis(p-phenoxy phenyl) ether, phenoxy phenylethers. The mixture of this invention are especially noteworthy since they are unexpectedly effective in mineral oils having a high sulfur content.

It is to be understood, however, that the compositions contemplated herein can also contain other materials. For example, corrosion inhibitors, extreme pressure agents, viscosity index improvers, co-antioxidants, antiwear agents and the like can be used. These materials do not detract from the value of the compositions of this invention, but rather they serve to impart their customary properties ot the particular compositions in which they are incorporated.

In general, the mixture of the present invention may be employed in any amount which is effective for imparting the desired degree of oxidation improvement. The mixture is effectively employed in amounts from 0.001% to about 0.2% by weight, and preferably from about 0.01% to about 0.1% of the total weight of the composition. When preparing the mixture of the two compounds, from about 20% to about 80%, preferably about 50% to about 70% of the benzotriazole adduct and from about 80% to about 20%, preferably from about 30% to about 50% of the thiadiazole are used. All percentages are by weight of total mixture.

The following examples will provide specific illustrations of the invention described hereinabove. They are illustrative only and are not to be considered as limitations upon the invention.

EXAMPLE 1

Adducts of Benzotriazole and n-Butyl Vinyl Ether

A mixture of 59.5 g. of benzotriazole, 100 g. of n-butyl vinyl ether and 100 ml. of benzene was heated at 90° C. (refluxing) for 6 hr. An additional 50 g. of n-butyl vinyl ether was added and refluxing at 90° C. was continued for about 5 hours after which unreacted n-butyl vinyl ether and the benzene solvent were removed by distillation. To the residue, petroleum ether (bp 30°-60° C.) was added and precipitated unreacted benzotriazole (9.1 g.) was removed by filtering. Distillation of solvent from the filtrate left 90 g. (97%) of the mixed isomeric addition product.

Gas chromatography showed that the reaction product consisted of two major components (isomers) which could not be separated by distillation. A narrow fraction, having a bp of 100°-103° C. at less than 0.1 mm. was estimated, from gas chromatography, to be a 30:70 mixture of isomeric mono-addition products.

Elemental analysis conformed to a mono-adduct reaction product having the empirical formula $C_{12}H_{17}N_3O$:

| Analysis (wt. %) | C | H | N |
|---|---|---|---|
| Calculated for $C_{12}H_{17}N_3O$: | 65.73 | 7.81 | 19.16 |

-continued

| Analysis (wt. %) | C | H | N |
|---|---|---|---|
| Found: | 66.34 | 7.63 | 19.9 |

One isomer (designated Isomer A) was separated by elution from a column packed with Alcoa F-20 alumina, using petroleum ether (bp 30°-60° C.) as a solvent. A satisfactory elemental analysis for the mono-adduct was obtained:

| Analysis for Isomer A (wt. %) | C | H | N |
|---|---|---|---|
| Calculated for $C_{12}H_{17}N_3O$: | 65.73 | 7.81 | 19.16 |
| Found: | 66.31 | 8.08 | 19.0 |

The ultra-violet spectrum of Isomer A showed maxima at 284.2, 277.6, 272.5 and a shoulder of 266.0 mμ.

The ultra-violet spectrum for the starting benzotriazole was significantly different, having maxima at 276, 259 and 254 mμ. The nmr proton spectrum had a quartet, indicating splitting of the proton by an adjacent methyl group showing that the isomer is a Markownikow adduct. Based on these data, it is concluded that Isomer A has the following structure:

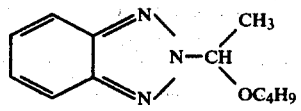

The second isomer (designated isomer B) was isolated by benzene elution from a neutral alumina column. A satisfactory elemental analysis for the mono adduct was also obtained:

| Analysis for Isomer B (wt. %) | C | H | N |
|---|---|---|---|
| Calculated for $C_{12}H_{12}N_3O$: | 65.73 | 7.81 | 19.16 |
| Found: | 65.60 | 7.78 | 19.4 |

The ultra-violet spectrum of Isomer B showed maxima at 282, 261, and 254.5 mμ. This is similar to the ultraviolet spectrum of the starting benzotriazole which showed maxima at 276, 259, and 254 mμ. The infrared spectrum of Isomer B showed significant differences from that of Isomer A. The nmr proton spectrum of Iomer B also had a quartet, indicating that a methyl group is splitting a single adjacent proton and this isomer is also a Markownikow adduct. Based on these data, it is concluded that Isomer B has the following structure:

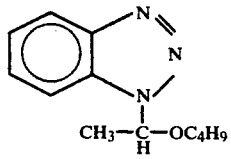

EXAMPLE 2

Toluotriazole and n-Butyl Vinyl Ether Addition Product

A mixture of 190 g. of toluotriazole (5-methylbenzotriazole), 300 g. of n-butyl vinyl ether and 200 ml. of benzene was heated, while refluxing at 88°-92° C., for a total of 14 hrs. Unreacted n-butyl vinyl ether and benzene solvent were removed by distillation under reduced pressure and the residue was cooled and filtered through a bed of Super Cel filter media. There was obtained thus 306 g. of the addition product, a clean dark amber liquid representing a yield of 92%.

EXAMPLE 3

Benzotriazole and Vinyl Acetate Addition Product-Base Catalyzed

To benzotriazole (59.5 g.) and potassium tert-butoxide in toluene (100 ml.), heated at 103°-115° C., vinyl acetate (86 g.) was added during about 2.25 hr. The reaction mixture was then heated at 98° C. while stirring for an additional 5 hr. period. The reaction mixture was washed with water, dried and stripped of solvent by rotary evaporation. The addition product (50.5 g.) m.p. 63°-64° C. was obtained from the residue by extraction with cyclohexane. Recrystallization from benzene gave a white crystalline solid, m.p. 64°-65° C. The infrared spectrum was consistent with the adduct structure. Elemental analysis was satisfactory:

| | C | H | N |
|---|---|---|---|
| Analysis calculated for $C_{10}H_{11}O_2N_3$: | 58.53 | 5.40 | 20.48 |
| Found: | 58.81 | 5.46 | 20.4 |

EXAMPLE 4

The alkyl dimercapto thiadiazole used in the following blends was purchased as Amoco 150. It is the product of Example VI of U.S. Pat. No. 3,719,125.

As was mentioned hereinabove, the mixture of this invention is surprisingly effective when used in a high sulfur oil, i.e., an oil containing up to about 1.2% of sulfur. It is also effective in increasing stability upon storage at 140° C. of used steam turbine oils, such as for example, Mobil's D.T.E. 797 oil.

EVALUATION OF PRODUCTS

Three different blends, made up as follows, were evaluated in various tests:

1. 99.4% of a 150 SUS solvent paraffinic neutral mineral oil comprising 0.05% of a mixture comprising (1) 60% of the reaction product of 1 mole of butyl vinyl ether and 1 mole of tolytriazole and (2) 40% of the alkyl dimercapto thiadiazole
2. a blend containing highly refined base stock having a SUS at 100° of 160 and a viscosity index of 111 blended with an additive system (not containing either of the materials of blend 1) and
3. a blend containing 25% of 1 and 75% of 2.

These tests included determination of neutralization number (NN) foaming tendency, rusting, copper corrosion and rotary bomb oxidation test (RBOT).

Copper Corrosion Test—ASTM D-130

A polished copper strip is immersed in a given quantity of sample and heated at a temperature and for a time characteristic of the material being tested. At the end of this period the copper strip is removed, washed, and compared with the ASTM Copper Strip Corrosion Standards. A temperature of 250° F. and a time of 3 hours were used.

Rotary Bomb Oxidation Test (RBOT)—ASTM D-2272

The test oil, water, and copper catalyst coil, contained in a covered glass container, are placed in a bomb equipped with a pressure gage. The bomb is charged with oxygen to a pressure of 90 psi, placed in a constant-temperature oil bath set at 150° C., and rotated axially at 100 rpm at an angle of 30 deg from the horizontal. The time for the test oil to react with a given volume of oxygen is measured, completion of the time being indicated by a specific drop in pressure.

Rust Test—ASTM D-665

The method involves stirring a mixture of 300 ml. of the oil under test with 30 ml. of distilled or synthetic sea water, as required, at a temperature of 140° F. (60° C.) with a cylindrical steel specimen completely immersed therein. It is customary to run the test for 24 hours; however, the test period may, at the discretion of the contracting parties, be for a shorter or longer period. The test was run for 24 hours using synthetic sea water at 140° F.

Foam Test—ASTM D-892

The sample, maintained at a temperature of 75° F. (24° C.) is blown with air at a constant rate for 5 minutes, then allowed to settle for 10 minutes. The volume of foam is measured at the end of both periods. The test is repeated on a second sample at 200° F. (93.5° C.), and then, after collapsing the foam, at 75° F. (24° C.).

The results are summarized in Table 1.

TABLE 1

| Blend | 1 | 2 | 3 |
|---|---|---|---|
| NN | 0.07 | 0.20 | 0.32 |
| Foam Test | 180/0 | 225/0 | 190/0 |
| Rust Test | Pass | Pass | Pass |
| Copper Corrosion Test | 1B | 1A | 1A |
| RBOT, Min. to 25 psi drop | 390/425 | 260 | 110 |

Other blends were made up as follows:

1. the base fluid containing 99.45% of a 150 second turbine base oil and an additive package (not the additive mixture of the invention), 2. blend 1 plus 0.05% by weight of a mixture containing (1) 60% by weight of the reaction product of 1 mole of butyl vinyl ether and 1 mole of tolyltriazole and (2) 40% by weight of the alkyl dimercapto thiadiazole, 3. blend 1 plus 0.05% by weight of the reaction product (1) of blend 2, 4. blend 1 plus 0.05% by weight of alkyl the dimercapto thiadiazole of blend 2.

These were evaluated in the tests described below. The tests were:

Total Oxidation Products Test (CIGRE)—IP 280

Oxygen is passed for 164 hours through a sample of the oil with the added soluble metal catalyst, iron and copper and maintained at 120° C. The volatile acid products, the acidity of the oil and the sludge formed are determined. If the measurement of the length of time to obtain a pronounced change in the rate of evolution of volatile acid is required, an acidity/time curve can be obtained by daily determinations of the volatile acids. The catalyst is a soluble copper salt.

Rotary Bomb Oxidation Test (RBOT)—ASTM D-2272

See the description of this test hereinabove.

Turbine Oil Stability Test (TOST)—ASTM D-943

The oil sample is subjected to a temperature of 194° F. in the presence of water, oxygen and an iron-copper catalyst. The test was carried out for 2500 hours.

TABLE 2

| Blend | 1 | 2 | 3 | 4 |
|---|---|---|---|---|
| CIGRE, Total oxidation Products | 5.53 | 0.29 | 1.15 | 5.22 |
| RBOT Min. to 25 psi drop | 315 | 440 | 400 | 395 |
| TOST @ 2500 hr. % Sludge, by wt. | 0.76 | 0.16 | 0.28 | 0.36 |

I claim:

1. A lubricating composition comprising a major proportion of an oleaginous material and an antioxidant amount of a mixture of (1) an adduct of a toluotriazole and n-butyl vinyl ether and (2) tertiary octyl 2,5-dimercapto-1,3,4-thiadiazole.

2. As a new composition of matter, the mixture comprising (1) an adduct of toluotriazole and n-butyl vinyl ether and (2) tertiary octyl 2,5-dimercapto-1,3,4-thiadiazole.

* * * * *